US006383700B1

(12) United States Patent
Yamazaki et al.

(10) Patent No.: US 6,383,700 B1
(45) Date of Patent: May 7, 2002

(54) IMAGE FORMING METHOD, IMAGE FORMING APPARATUS, AND DEVELOPER MATERIAL USED IN SAID APPARATUS

(75) Inventors: Hiroshi Yamazaki; Hiroyuki Yamada; Meizo Shirose; Shigenori Kouno; Akihiko Itami, all of Hachioji (JP)

(73) Assignee: Konica Corporation (JP)

( * ) Notice: Subject to any disclaimer, the term of this patent is extended or adjusted under 35 U.S.C. 154(b) by 7 days.

(21) Appl. No.: 09/687,887

(22) Filed: Oct. 13, 2000

(30) Foreign Application Priority Data

Oct. 22, 1999 (JP) ..... 11-301065

(51) Int. Cl.[7] ..... G03G 15/04

(52) U.S. Cl. ..... 430/66; 430/97; 430/137.15; 399/159; 399/358

(58) Field of Search ..... 430/66, 97, 137.15; 399/159, 358

(56) References Cited

FOREIGN PATENT DOCUMENTS

| | | |
|---|---|---|
| JP | 6118681 | 4/1994 |
| JP | 9124943 | 5/1997 |
| JP | 9190004 | 7/1997 |

*Primary Examiner*—Mark Chapman
(74) *Attorney, Agent, or Firm*—Bierman, Muserlian and Lucas

(57) ABSTRACT

In an electrostatic image forming method, said electrophotographic photoreceptor comprises a resinous layer comprising siloxane base resin containing a structural unit having charge transport performance and a cross-linked structure on an electrically conductive support, and developer material comprises a toner which is obtained by suspension-polymerizing a polymerizable composition comprised of at least polymerizing monomer and colorant or a toner which is obtained by fusing at least said resin particles in an aqueous medium.

15 Claims, 2 Drawing Sheets

IMAGE FORMING METHOD, IMAGE FORMING APPARATUS, AND DEVELOPER MATERIAL USED IN SAID APPARATUS

FIELD OF THE INVENTION

The present invention relates to an image forming method, an image forming apparatus, and a developer material used with said apparatus.

BACKGROUND OF THE INVENTION

In recent years, image forming techniques, which are employed in copiers, printers, facsimile machines, and the like, have progressed markedly. Of these, the most frequently employed technique relates to an electrostatic image forming method represented by the conventional electrophotographic system.

The reasons for this progress are considered to be as follows. The electrostatic image forming methods, such as an electrophotographic system and the like, are capable of producing high quality images at a high speed, are capable of forming color images in addition to monochromatic images, and exhibit durability as well as stability over an extended period of time.

In said electrophotographic system, after charging the entire surface of a so-called photoreceptor, exposure corresponding to an image to be formed is provided and an electrostatic latent image is formed. Then the resulting electrostatic latent image is visualized employing a toner and thus images are formed.

In recent years, widely employed as electrophotographic photoreceptors have been organic photoreceptors comprising organic photoconductive materials. As compared to other photoreceptors, organic photoreceptors exhibit the following advantages, that is, it is easy to develop materials for organic photoconductors, which respond to various types of exposure light sources, from visible light to infrared radiation; it is also possible to select materials which do not cause environmental pollution; production cost is lower; and the like. The only one defect is that the mechanical strength is not sufficient and during copying or printing a large number of sheets, the photoreceptor surface suffers from wear as well as from abrasion.

Such photoreceptors are prepared employing either of the following methods: an organic charge generating material is evaporated onto an electrically conductive support which is generally comprised of aluminum or an aluminum alloy; a coating composition, prepared by blending an organic charge generating materials and organic polymer resins as the binders with a solvent, is applied onto a support to form a charge generating layer, and onto the resultant charge generating layer, a coating composition prepared by blending an organic charge transport material and an organic polymer resin as the binder with a solvent is applied to form a charge transport layer.

In an electrophotographic apparatus employing the Carlson method, generally, after uniformly charging a photoreceptor, the resultant charge is eliminated by imagewise exposure to form an electrostatic latent image, which is visualized through development employing a toner, transferred to a sheet of paper and the like, and subsequently fixed.

However, all toner particles on the photoreceptor are not transferred and some toner remains on the photoreceptor. When imaging is repeated in such a state, it is impossible to obtain high image quality copies without staining because the formation of latent images is put into disorder due to the residual toner particles. In order to overcome this problem, it is necessary to remove the residual toner. Listed as representative cleaning means are a fur brush, a magnetic brush, a blade, and the like. However, from the viewpoint of performance, structure, and the like, a blade is primarily employed. Generally employed as said blade member is a board shaped rubber elastic body.

As described above, electrical and mechanical external force from a charging device, a development device, a transfer means, a cleaning device, and the like is directly applied to the surface of the electrophotographic receptor. Therefore, durability to counter these forces is demanded. Specifically demanded is mechanical durability against wear as well as abrasion of the photoreceptor surface due to sliding, layer peeling due to impact and the like during corrective action to counter the introduction of foreign matter and paper clogging. Of these, further demanded is enhanced resistance to counter abrasion and layer peeling due to impact.

In order to satisfy the various properties demanded as described above, heretofore, various means have been investigated.

Regarding said mechanical durability, it is reported that surface wear characteristics as well as toner filming characteristics are improved by applying BPZ polycarbonate as the binder to the surface of an organic photoreceptor. Further, Japanese Patent Publication Open to Public Inspection No. 6-118681 discloses that hardenable silicone resins comprising colloidal silica are employed as the surface protective layer of photoreceptors.

However, photoreceptors, which are comprised of said BPZ polycarbonate binder, exhibit insufficient wear resistance properties and thus do not exhibit sufficient durability. On the other hand, the surface layer, which is comprised of hardenable silicone resins containing colloidal silica, exhibits improved wear resistance properties. However, background stain as well as image blurring tends to occur due to insufficient electrophotographic properties during repeated use. Accordingly, said surface layer also exhibits insufficient durability.

As methods to overcome these drawbacks, Japanese Patent Publication Open to Public Inspection Nos. 9-124943 and 9-190004 propose photoreceptors which have, as the surface layer, a layer comprised of resins prepared by bonding organic silicon modified positive hole transport compounds to hardenable organic silicon based polymers. However, in said technique, since the surface layer is hardened, the photoreceptor surface is minimally abraded. As a result, it is extremely difficult to remove moisture which is adsorbed at an ambience of high temperature and high humidity. Thus image blurring results, and paper dust as well as toner filming tends to be produced. As a result, image problems such as streaking or spotting tend to occur.

SUMMARY OF THE INVENTION

An object of the present invention is to provide an image forming method in which a photoreceptor, which results in no wear, is employed, and over an extended period of time, consistent images can be formed without causing image problems such as image blurring as well as streaking or spotting.

The present invention and its embodiments will now be described.

In an image forming method in which a latent image on an electrophotographic photoreceptor is developed employing a developer material, and after transferring the resultant developed toner image on a recording material, the residual toner on said photoreceptor is removed, an image forming method in which said electrophotographic photoreceptor comprises an electrically conductive support having thereon a resinous layer comprising siloxane based resin containing a structural unit having charge transport performance and a cross-linked structure, and said developer material comprises a toner which is obtained by suspension-polymerizing a polymerizable composition comprised of at least polymerizable monomers and colorants or a toner which is obtained by fusing at least said resin particles in an aqueous medium.

In an image forming method in which a latent image on an electrophotographic photoreceptor is developed employing a developer material, and after transferring the resultant developed toner image on a recording material, the residual toner on said photoreceptor is removed, an image forming method in which said electrophotographic photoreceptor comprises an electrically conductive support having thereon a resinous layer comprising siloxane based resin containing a structural unit having charge transport performance and a cross-linked structure, and said developer material comprises a toner which is obtained by suspension-polymerizing a polymerizable composition comprised of at least polymerizable monomers and colorants.

Said siloxane based resin, which comprises the structural units having charge transport performance and a cross-linked structure, is preferably siloxane based resin having a compound group having charge transport performance, as its partial structure.

Said siloxane based resin, which comprises the structural unit having charge transport performance and a cross-linked structure, is preferably obtained by allowing an organic silicon compound having a hydroxyl group or a hydrolyzable group to react with a charge transport compound having a hydroxyl group.

In an image forming method in which a latent image on an electrophotographic photoreceptor is developed employing a developer material, and after transferring the resultant developed toner image onto a recording material, the residual toner on said photoreceptor is removed, an image forming method in which said electrophotographic photoreceptor comprises an electrically conductive support having thereon a resinous layer comprising siloxane based resin containing a structural unit having charge transport performance and a cross-linked structure, and a toner employed in said developer material is one which is obtained by fusing at least said resin particles in an aqueous medium.

Said siloxane based resins, which comprise the structural units having charge transport performance, as well as having a cross-linked structure, are preferably obtained by allowing an organic silicon compound having a hydroxyl group or a hydrolyzable group to react with a charge transport compound having a hydroxyl group.

In an image forming apparatus in which a latent image on an electrophotographic photoreceptor is developed employing a developer material, and after transferring the resultant visualized image onto a recording material, the residual toner on said photoreceptor is removed employing a cleaning means, an image forming apparatus in which said electrophotographic photoreceptor comprises an electrically conductive support having thereon structural units having charge transport performance, as well as having a resinous layer comprising siloxane based resins having a cross-linked structure, and a toner employed in said developer material is one which is obtained by fusing at least resin particles in an aqueous medium.

DETAILED DESCRIPTION OF THE INVENTION

Figure 1:
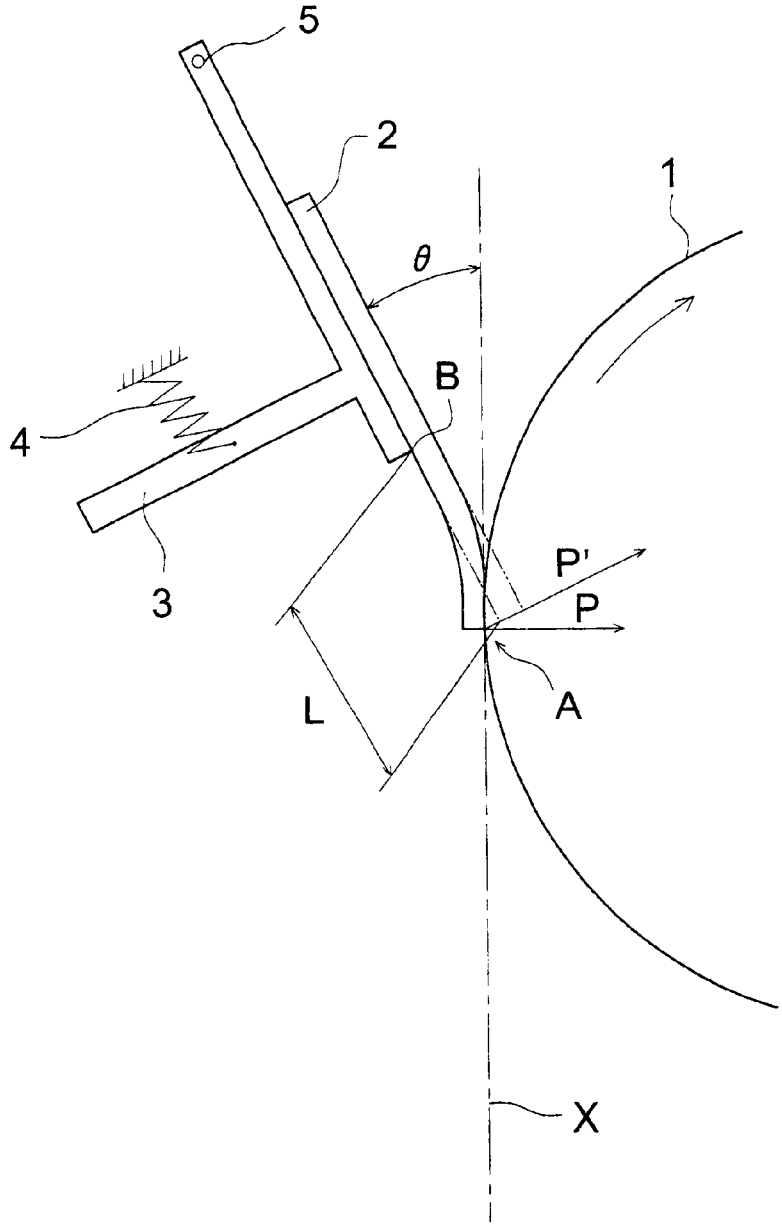
FIG. 1 is a cross-sectional view of one example of a cleaning mechanism employed in the present invention.

In the present invention, image problems such as image blurring, as well as streaking or spotting, which are generated employing a wear resistant photoreceptor in an ambience of high temperature and high humidity, have been overcome by improving a toner.

The inventors of the present invention capitalized on the fact that moisture adsorbed by a toner is a supply source of moisture to the photoreceptor.

In a conventional so-called pulverized toner which is prepared by melt-kneading resins, colorants, and the like, and pulverizing of the resultant mixture, fine concave and convex sites on broken-out surfaces formed by pulverization tends to adsorb moisture. As a result, the migration of adsorbed moisture onto the photoreceptor surface results in image blurring.

On the other hand, a toner prepared employing a so-called suspension polymerization method tends to form spherical shapes which have the small surface area. As a result, the number of moisture adsorption sites is less. Thus it is possible to decrease the adsorbed moisture amount. Further, by employing removable inorganic dispersion stabilizers for the suspension polymerization method, it is possible to minimize the amount of dispersion stabilizers on the surface. Thus, it is possible to further retard the moisture adsorption onto the surface.

Still further, in a toner, which is formed by fusing resin particles, said toner surface has no active sites which are formed during crushing and which is therefore a smooth structure. Thus, on said surface is no site which adsorbs moisture and the like, and it is therefore possible to minimize adsorbed moisture.

As a result, even when a photoreceptor, which exhibits high wear resistance, is employed, it is possible to minimize the formation of image blurring and also to form consistent images over an extended period of time.

Elements, requirement and apparatus concerning the invention are described.

Raw Material

As polymerizable monomer to use in order to get an amorphous polymer, radically polymerizable monomer is used as a component, and crosslinking agent can be used at need. And it is preferable to contain at least one kind of radically polymerizable monomer having an acidic group or a radically polymerizable monomer having basic group mentioned below.

(1) Radically Polymerizable Monomer

As radically polymerizable monomer component, radically polymerizable monomer can be employed without particular restriction. And those of one kind or two kinds or more are employed in combination to meet demanded characteristics.

To be concrete, aromatic system vinyl monomer, (meta) acrylate series monomer, vinyl ester series monomer, vinyl ether series monomer, monoolefin series monomer, diolefin series monomer, halogenation olefin series monomer etc. can be employed.

As aromatic system vinyl monomer, for example, styrene series monomer such as styrene, o-methylstyrene, m-methylstyrene, p-methylstyrene, p-methoxystyrene, p-phenyl styrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene and their derivatives are mentioned.

As (meta)acrylate series monomer, methyl acrylate, ethyl acrylate, butyl acrylate, 2-ethylhexyl acrylate, cyclohexyl acrylate, phenylacrylate, methyl methacrylate, ethyl methacrylate, butyl methacrylate, hexyl methacrylate, methacrylic acid-2-ethylhexyl, β-hydroxy ethyl acrylate, γ-amino propyl acrylate, methacrylic acid stearyl, dimethylaminoethyl methacrylate, methacrylic acid diethylaminoethyl are exemplified.

As the vinyl ester series monomer, vinyl acetate, vinyl propionate, vinyl benzoate are exemplified.

As vinyl ether series monomer, vinylmethylether, vinyl ethyl ether, vinyl isobutyl ether and vinylphenyl ether are exemplified.

As monoolefin series monomer, ethylene, propylene, isobutylene, 1-butene, 1-pentene and 4-methyl-1-pentene are exemplified.

Butadiene, isoprene and chloroprene are exemplified for diolefin series monomer.

Chloroethylene, vinylidene chloride and vinyl bromide are exemplified for halogenated olefin series monomer.

(2) Crosslinking Agent

A crosslinking agent such as radically polymerizable crosslinking agent may be added in order to improve characteristics of toner.

As the radically polymerizable crosslinking agent, those having two or more unsaturated bond such as divinylbenzene, divinyl naphthalene, divinyl ether, diethyleneglycol methacrylate, ethylenglycol dimethacrylate, polyethyleneglycol dimethacrylate and diallyl phthalate is exemplified.

(3) Radically Polymerizable Monomer Having Acidic Group and Radically Polymerizable Monomer Having Basic Group Examples of the radically polymerizable monomer having acidic group and the radically polymerizable monomer having basic group include a carboxyl group containing monomer, a sulfonic acid group containing monomer and an amine compound such as primary amine, secondary amine, tertiary amine, a quaternary ammonium salt.

As the radically polymerizable monomer having acidic group, carboxylic group containing monomer such as acrylic acid, methacrylic acid, fumaric acid, maleic acid, itaconic acid, cinnamic acid, maleic acid monobutyl ester, maleic acid mono octyl ester are mentioned.

Styrenesulfonic acid, allylsulfo succinic acid, allyl sulfo succinic acid octyl are mentioned for sulfonic acid group containing monomer.

These may have a structure of alkali metal salt such as sodium or potassium salt, or alkaline earth metal salt such as calcium salt.

As for radically polymerizable monomer having basic group compound, amine series is nominated, whose examples are dimethylaminoethyl acrylate, dimethylaminoethyl methacrylate, diethylaminoethyl acrylate, diethylaminoethyl methacrylate and quaternary ammonium salt of the 4 compounds mentioned above, 3-dimethylaminophenyl acrylate, 2-hydroxy-3-methacryloxy propyl trimethylammonium salt, acrylamide, N-butylacrylamide, N, N-dibutyl acrylamide, piperidyl acrylamide, methacryl amide, N-butyl methacryl amide, N-octadecyl acrylamide, vinylpyridine, vinylpyrrolidone, vinyl N-methylpyridinium chloride, vinyl N-ethyl pyridinium chloride, N, N-diallyl methylammonium chloride, and N, N-diallyl ethylammonium chloride.

It is preferable to use 0.1–15 mass % of the radically polymerizable monomer having acidic group or the radically polymerizable monomer having basic group as radically polymerizable monomer employed in the present invention with respect to whole monomers, and radically polymerizable crosslinking agent is employed, depending on its characteristics, in an amount of 0.1–10 mass % of whole radically polymerizable monomer.

Chain Transfer Agent

Chain transfer agent may be employed to adjust molecular weight of the amorphous polymer.

As the chain transfer agent, octyl mercaptan, dodecyl mercaptan, mercaptan of tert-dodecyl mercaptan, styrene dimer etc. are employed without particular restriction.

Polymerization Initiator

A radical polymerization initiator can be employed appropriate as far as it is oil soluble in the present invention.

Example of the oil soluble initiator includes peroxide compound such as benzoyl peroxide, lauroyl peroxide, cumen hydroperoxide, t-butyl hydroperoxide, dicumyl peroxide, cumen hydroperoxide, acetyl peroxide, and propionyl peroxide; and azobis compound such as 2,2'-azobisisobutylonitril, 2,2'-azobis(2,4-valeronitril), 2,2'-azobis-2-metylvaleronitrtil, and 2,2'-azobis-2,4-dimethylvaleroniril.

Polymerization temperature may be optionally selected if it is more than the minimum radical generation temperature of polymerization initiator, and, for example, 50 to 90° C. is employed.

Amount of the initiator is determined by molecular weight of resin employed in toner, and in general 0.1 to 10 mass %, preferably 0.2 to 5 mass % with respect to amount of the radical polymerization monomer.

As for the preferable dispersion stabilizer those can be finally removed easily at filtration or washing step are mentioned. Particularly inorganic dispersion stabilizer slightly soluble in water is preferably employed. Practical example includes calcium carbonate, tricalcium phosphate, aluminum oxide, barium carbonate, magnesium carbonate, barium sulfate, aluminum hydroxide, titanium oxide, silicon oxide and iron hydroxide. Particularly preferable dispersion stabilizer is tricalcium phosphate. Small amount of surfactant may be employed as the dispersion aid in addition to the inorganic dispersion stabilizer slightly soluble in water. In this instance a nonionic, anionic, cationic or amphoteric surfactant may be employed.

The dispersion stabilizer is employed by dispersing in aqueous medium, wherein amount of 1 to 10 mass % of the oil phase component to be dispersed is preferably employed to ensure the stable dispersion without occurrence of coagulation or excess of fine particle component.

The surfactant is employed preferably in amount of 0.05 to 1 mass % of the inorganic dispersion stabilizer to ensure improving dispersion stabilization and restraining formation of emulsion of radical polymerization monomer, i.e., latex particles which makes particle size distribution wider, or inducing water adsorption.

A polymerization initiator may be employed in a step of preparation of resin particles by salting and fusion after preparation of resin particles by, so called, emulsion polymerization method. For this purpose any of water soluble initiator can be employed. Examples include peroxide salt such as potassium peroxide and ammonium peroxide; azo compounds such as 4,4'-azobis-4-cyanovalerate or its salt, and 2,2[-azobis(2-amindinopropane); and peroxide compounds.

The radial polymerization initiator can be employed as a redox polymerization initiator in combination with a reducing agent. Polymerization temperature can be lowered and polymerization time can be reduced by employing the redox initiator.

Polymerization temperature is selected optionally as far as it is high than the minimum radical formation temperature, for example, 50 to 90° C. Polymerization can be occurred at room temperature or higher when the initiator working at room temperature is employed.

Coloring Agent

Inorganic pigment and organic pigment can be employed for coloring agent to constitute toner of the present invention.

Arbitrary inorganic pigment can be employed. Practical inorganic pigment is listed below.

Carbon black such as furnace black, channel black, acetylene black, thermal black and lamp black is exemplified as black pigment. Magnetic powders such as magnetite and ferrite are employed for black pigment.

These inorganic pigments can be used individually or two or more in combination selected according to needs.

And the content of pigment is usually 2–20 mass %, and preferably, 3–15 mass % of polymer.

The above-mentioned magnetite can be employed to use as magnetic toner. It is preferable to employ 20–60 mass % of magnetite in toner from a point of view to give predetermined magnetic characteristics in this case.

An organic pigment can be also employed. Practical organic pigment is exemplified below.

Magenta or Red Pigment

C.I. Pigment red 2, C.I. Pigment red 3, C.I. Pigment red 5, C.I. Pigment red 6, C.I. Pigment red 7, C.I. Pigment red 15, C.I. Pigment red 16, C.I. Pigment red 48:1, C.I. Pigment red 53:1, C.I. Pigment red 57:1, C.I. Pigment red 122, C.I. Pigment red 123, C.I. Pigment red 139, C.I. Pigment red 144, C.I. Pigment red 149, C.I. Pigment red 166, C.I. Pigment red 177, C.I. Pigment red 178, and C.I. pigment red 222.

Orange or Yellow Pigment

C.I. Pigment orange 31, C.I. Pigment orange 43, C.I. Pigment yellow 12, C.I. Pigment yellow 13, C.I. Pigment yellow 14, C.I. Pigment yellow 15, C.I. Pigment yellow 17, C.I. Pigment yellow 93, C.I. Pigment yellow 94, C.I and Pigment yellow 138.

Green or Cyan Pigment

C.I. Pigment blue 15, C.I. Pigment blue 15:2, C.I. Pigment blue 15:3, C.I. Pigment blue 16, C.I. Pigment blue 60 and C.I. pigment green 7.

These organic pigments can be used individually or two or more jointly selected according to needs. And content of pigment is usually 2–20 mass % and preferably 3–15 mass % for polymer.

The colorant subjected to surface modification can be employed. The practical surface modifying agent includes silane coupling agent, titanium coupling agent and aluminum coupling agent.

So-called outer additive is added to toner of the present invention for a purpose of improvement of fluidity, charging characteristics and cleaning characteristics. Various kinds of inorganic fine particles, organic fine particles and lubricant can be employed. Various inorganic fine particles can be used.

As fine particles of silica R-805, R-976, R-974, R-972, R-812 and R-809 manufactured by Nihon Aerosil Co., Ltd., HVK-2150 and H-200 manufactured by Hoechst company, TS-720, TS-530, TS-610, H-5 and MS-5 manufactured by Cabot company, are mentioned as practical example.

As titanium fine particle, T-805 and T-604 manufactured by Nihon Aerosil Co., Ltd., MT-100S, MT-100B, MT-500BS, MT-600, MT-600SS and JA-1 manufactured by TAYCA Corporation, TA-300, SI TA-500, TAF-130, TAF-510 and TAF-510T manufactured by Fuji titanium company, IT-S, IT-OA, IT-OB and IT-OC manufactured by Idemitsu Kosan company, are mentioned for example.

As alumina fine particle, RFY-C and-C-604 manufactured by Nihon Aerosil Co., Ltd., TTO-55 of manufactured by ISHIHARA SANGYO KAISHA, LTD. are given for example.

Spherical organic fine particles having number average primary particle diameter around 10–2000 nm can be employed. Homopolymer such as styrene or methyl methacrylate and copolymer of these can be used.

As lubricant, for example, stearic acid salt of such as zinc, aluminum, copper, magnesium and calcium, salt of oleic acid of such as zinc, manganese, iron, copper and magnesium, palmitic acid salt of such as zinc, copper, magnesium and calcium, linoleic acid salt of such as zinc and calcium, ricinoleic acid salt of such as zinc and calcium, and metal salt of higher fatty acid are given.

Content of this outer additive is preferably around 0.1–5 weight % for toner.

<Suspension Polymer Toner Production Processes>

The preparation of polymerization toner process comprises a step of dispersing necessary toner components such as initiator, pigment and releasing agent into radical polymerization monomer, a step of dispersing the dispersion of pigment etc. in water to obtain droplets having particle desirable diameter for toner, a step of polymerization, a step of removing the dispersion stabilizer, washing and filtering, and a step of drying.

Preferably employed during dispersion of a pigment are an ultrasonic homogenizer, a mechanical homogenizer, pressure dispersion machine such as a Manton-Gaulin homogenizer, a pressure type homogenizer, and the like, or medium type dispersion machine such as a sand grinder, a Getzmann mill, a diamond mill, and the like. The dispersion is preferably conducted with cooling since polymerization initiator is employed which should not affect by heat while dispersion process.

It is necessary to regulate the condition so that the formed droplets have desirable particle diameter when the dispersion is dispersed in the aqueous medium. A dispersion machine employed in this instance includes TK homomixer, TK homojetter, rotary dual cylinder, ultrasonic dispersion machine and so on. Droplets are observed by, for example, a microscope during the dispersion, and droplets having desirable particle diameter can be obtained by stopping the dispersing process at the point that the droplets become to have predetermined particle size.

The average particle diameter of the toner obtained by fusing colored particles is preferably between 3 and 9 $\mu$m. The volume average particle diameter of the toner may be measured employing a Coulter Counter TA-II, a Coulter Multisizer or SLAD1100, a laser diffraction particle size analyzer manufactured by Shimadzu Mfg., Co., LTD. The average particle size is measured in the particle size range of 2.0 to 40 $\mu$m by employing an aperture of 100 $\mu$m when using Coulter Counter TA-II, a Coulter Multisizer.

The polymerization is conducted at a temperature over the decomposition point of polymerization initiator. In general preferable is 50 to 90° C.

After completion of polymerization the resultant is cooled and preferably acid is added thereto for the purpose of removing dispersion stabilizer. Examples of acid include hydrochloric acid, sulfuric acid etc. Toner is obtained by subjecting to filtration, washing with water and drying. Process of preparation of salt-out or fused toner.

The preparation process of salt-out or fused toner includes a step of polymerization which prepare resin particles which may contain colorant by emulsion polymerization, a step of fusing the resin particles with colorant particles or resin particles containing colorant employing the above mentioned resin particles dispersion in a aqueous medium, a step of washing wherein the obtained particles are filtrated from the aqueous medium and surfactant etc. are removed therefrom, a step of dying the obtained particles, and further a step of adding additives from outside of the particles. Resin particles containing no colorant can be employed for the resin particles. In this instance the resin particles can be colored by fusing with colorant particles in aqueous medium after that colorant particle dispersion liquid is added to the dispersion liquid of the resin particles.

As for the fusing method it is preferable to salt-out and fuse by employing resin particles formed by polymerization process. In case that resin particles containing no colorant are employed, the resin particles and the colorant particles.

Further, it is possible to fuse fine particles of internal additives such as releasing agents, charge control agents, and the like, along with fine resin particles and fine colorant particles.

The water based medium means one in which the main component (at least 50 percent by weight) is water. Herein, listed as components other than water may be organic solvents which are soluble in water. Examples include methanol, ethanol, isopropanol, butanol, acetone, methyl ethyl ketone, tetrahydrofuran and the like. Of these, alcohol based organic solvents, which do not dissolve resins, are specifically preferred.

Homogenizers, which are employed for said dispersion process of magnetic substance, are not particularly restricted, and preferably cited are ultrasonic homogenizers, mechanical homogenizers, pressurized homogenizers such as Manton-Gaulin and pressure type homogenizers, medium type homogenizers such as sand grinders, a Getzmann mill, a diamond fine mill, and the like.

Further, listed as employed surface active agents may be those which are the same as described above.

The preferred salting-out/fusing method comprises a process in which a salting-out agent, comprised of alkali metal salts, alkali earth metal salts, and the like, is added as a flocculant into water comprising fine resin particles as well as fine colorant particles in an amount of exceeding the critical flocculation concentration and subsequently, by heating at a temperature above the glass transition point of said fine resin particles, salting-out and fusion are simultaneously carried out. In this process, employed may be a method in which an organic solvent, which is infinitely soluble in water, is added to substantially lower the glass transition temperature of said fine resin particle so that fusion is effectively carried out.

Herein, in alkali metal salts and alkali earth metal salts employed as salting-out agents, listed as alkali metals are lithium, potassium, sodium, and the like, and as alkali earth metal are magnesium, calcium, strontium, barium, and the like. Cited as preferred metals are potassium, sodium, magnesium, calcium, and barium. Cited as formed salts are chlorides, bromides, iodides, carbonates, sulfates, and the like.

When the salting-out/fusion of the present invention is carried out, it is preferable that the resting time after the addition of a salting-out agent is as short as possible. This reason for the benefit of a short rest period is not yet totally understood. However, depending on the rest time after salting-out, problems occur in which the particle diameter distribution fluctuates due to variation of the flocculation state of the particles, and also do the surface properties of fused toner fluctuate. Further, it is necessary that the temperature, at which the salting-out agent is added, is no higher than the glass transition temperature of fine resin particles. The reason for this is understood to be as follows. When a slating-out agent is added at a temperature higher than the glass transition temperature of the fine resin particles, the salting-out/fusion of said resin particles proceeds rapidly. However, it is extremely difficult to control the particle diameter, and problems occur in which large diameter grains are generated. This addition temperature range is to be no higher than the glass transition temperature of said resin, and is generally between 5 and 55° C., and preferably between 10 and 45° C.

Further, in the present invention, it is preferable to employ a method in which a salting-out agent is added at no higher than the glass transition temperature of fine resin particles, and thereafter, the resultant mixture is heated as soon as possible so that it is heated to at least the glass transition temperature of the same or higher. The time until to said temperature is preferably less than one hour. In addition, it is necessary to rapidly raise said temperature. The rate of temperature rise is preferably 0.25° C./minute. The upper limit is not specifically stated. However, when the temperature is abruptly raised, salting-out proceeds too quickly and problems occur in which it is difficult to control the particle diameter. Thus, said rate is preferably 5° C./minute or less.

Herein, the volume average particle diameter of the toner is preferably between 3 and 9 $\mu$m, and is more preferably between 4 and 8 $\mu$m.

The volume average particle diameter as described herein is a value measured employing a Coulter Counter TA-11, Coulter Multisizer, SLAD1100 (a laser diffraction type particle diameter meter, manufactured by Shimadzu Seisakusho). Employing the Coulter Counter TA-11 and Coulter Multisizer, the values are shown employing a particle distribution in the range of 2.0 to 40 $\mu$m with the use of an aperture diameter of 100 $\mu$m.

The shape coefficient of said toner particles obtained by fusion, which is described by the formula below, is 1.3 to 2.2, and the ratio of toner particles having a shape coefficient of 1.5 to 2.0 is at least 80 percent by number.

$$\text{Shape coefficient}=[(\text{maximum diameter}/2)^2\times\pi]/\text{projection area}$$

In order to obtain this shape coefficient, toner particles are magnified 500 times employing a scanning type electron microscope and their image is photographed. Subsequently, employing the resulting electron microscopic image, the photographic image is analyzed, using "SCANNING IMAGE ANALYSER" (manufactured by Nippon Denshi Co.). At the time, a figure, which is statistically meaningful, for example 500 colored particles, is employed. The shape coefficient is calculated by the formula described above.

When particles have a shape coefficient of less than 1.3, charge density increases due to the fact that the shape of the particles approaches a sphere, resulting in deteriorating effect of restrain repellency during fixing process since accumulation of charge becomes excess when transferring process is repeated.

On the other hand, when incorporating toner having a shape coefficient of no less than 2.2, the ratio of colored particles having an irregularly uneven surface increases and charge maintaining ability decreases. As the result, adhesion force of the toner is lowered, whereby such problems may arise that the transferred toner on the image carrier moves due to vibration during transportation, and therefore, image defects such as character scattering may appear.

Furthermore, when the ratio of colored particles having a shape coefficient in the range of 1.5 to 2.0 is 80 percent by number or more, the distribution of charge amount and the like is uniformed due to the decrease in the ratio of particles having different shapes or excessively sphere shapes. As a result, disadvantage mentioned above is restrained for long term.

Toner Preparation Process

Toner may be prepared by employing the toner particles obtained by above process, without giving further process, or adding the additives mentioned above for the purpose of, for example, improving fluidity, charging characteristics and cleaning characteristics.

Listed as devices employed to add said additives may be various mixers such as a tubular mixer, a Henschel mixer, a Nauter mixer, a V-shaped mixer, and the like, which are known in the art.

The toner may contain such component as releasing agent and charge control agent inside of the particle. Specifically, examples of the releasing agent includes low molecular weight polypropylene, low molecular weight polyethylene, natural waxes such as carnauba wax, amide wax and the like.

In the same manner, it is possible to use various charge control agents which are known in the art and are capable of being dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof, and the like.

Particles of these releasing agents and charge control agents preferably have a number average particle diameter of 10 to 500 nm in the dispersed state.

<Developers>

The toner of the present invention may be employed as either a single component developer or a two-component developer. However, it is preferably employed as a two-component developer.

When employed as a single component developer, there is a method in which said toner is employed as a non-magnetic single component developer without any further alteration. Generally, however, magnetic particles having a size of about 0.1 to about 5 $\mu$m are incorporated into toner particles and employed as a magnetic single component developer. As the incorporation method, magnetic particles are incorporated into non-spherical particles in the same manner as for colorants.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 $\mu$m, and more preferably have one between 25 to 60 $\mu$m.

The volume average particle diameter of said carrier is typically measured employing a laser diffraction type particle distribution meter, "HELOS", (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

Photoreceptor employed in the invention is described.

The siloxane based resin is prepared by employing organic silicone compound having hydroxy group or a hydrolyzable group in a conventional way. The organic silicone compound is represented by the following Formula A, B, C or D.

Formula (A)

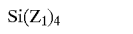

Formula (B)

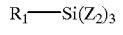

Formula (C)

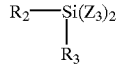

Formula (D)

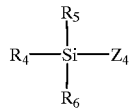

In the formulas, $R_1$ through $R_6$ are each an organic group in which a carbon atom thereof is directly boned with the silicon atom in the formula, each of $Z_1$ to $Z_4$ is a hydroxyl group or a hyrolyzable group.

When $Z_1$ to $Z_4$ in the above formulas is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by $R_1$ through $R_6$ in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β(3,4-epoxycyclohexyl)ethyl group, an (metha)acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a nonafluorohexyl group and perfluorooctylethyl group, and an alkyl group substituted by a nitro group or a cyano group. The organic groups represented by $R_1$ through $R_6$ may be the same as or different from each other.

Generally, the reaction of the organic siloxane compound for preparing a charge transportable polysiloxane resin, that is also called as siloxane resin having structural unit capable of charge transferring property and crosslinking structure, is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling such the factors can control the storage ability of the coating liquid of the layer and the hardness of the coated layer.

Generally, the reaction of the organic siloxane compound for preparing a charge transportable polysiloxane resin, that is also called as siloxane resin having structural unit capable of charge transferring property and crosslinking structure, is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling such the factors can control the storage ability of the coating liquid of the layer and the hardness of the coated layer.

Hydrolyzed condensation product which the organic silicon compound mentioned above is oligomerized or polymerized by subjecting to hydrolysis in acid or alkali condition may be employed for the starting material of the siloxane hardening resin.

The siloxane resin of the invention is a resin which is formed and hardened by a reaction (including a hydrolyzing, and a reaction in the presence of a catalyst or a cross-linking agent) of a monomer, an oligomer or a polymer having a siloxane bond in the chemical structural thereof unit to form a three-dimensional network structure.

In another words, the siloxane resin of the invention means a cross-linked siloxane resin formed as a result of the formation of three-dimensional network structure by acceleration of siloxane bonding formation of the organic compound having a siloxane bond by a hydrolyzing reaction and a dehydrating reaction.

Moreover, the siloxane resin may be a resin containing a silica particle as a part of the cross-linked structure by adding a colloidal silica particle having a hydroxyl group or a hydrolyzable group.

In other definition, the charge transportable structural unit is a chemical structural unit or a residue of charge transportable compound by which an electric current caused by charge transportation can be detected by a known method for detecting the charge transportation ability such as Time-Of-Flight method.

In the invention the cross-linked siloxane resin having a charge transportable structural unit is a siloxane resin in which a chemical structure showing a drift mobility of electron or a hole (i.e., the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

The charge transferable compound which can form a group having the charge transporting ability through reaction with an organic silicone compound as a structural unit in the cross-linked polysiloxane hardenable resin is described.

Examples of hole transporting type CTM which each are contained in the siloxane resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM which each are contained in the siloxane resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4,'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalono-nitrile, polynitro-9-fluorenylidenedicyanomethylenemalono-dinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and mellitic acid.

In the invention, preferable charge transportable structural units are residues of usually used charge transporting compounds such as mentioned above. The residue is bonded with the bonding atom or group represented by Z through the carbon atom or the silicon atom constituting the charge transporting compound so as to be contained in the siloxane resin.

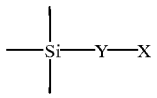

In the formula, X is a group having charge transportability and connects to Y by carbon atom or silicon atom composing the group. Y is a bonding group having two or more valences.

When Y is three or more valent atom, the bonding hand other than those each bonding with Si and C is bonded with any atom constituting the hardened resin, or another atom or molecular group.

In the above-mentioned formula, the atom represented by Z is preferably an oxygen atom 0, a sulfur atom S or nitrogen atom N.

In the formula, Y is a nitrogen atom (N), the above-mentioned bonding group is represented by —NR—, wherein R is a hydrogen atom or a mono-valent organic group.

Although the charge transportable structural unit X is shown as a mono-valent group in the formula, the structural unit may be bonded as a two or more valences cross-linking group in the hardened resin or as a simple pendant group when the charge transporting compounds to be reacted with the siloxane resin has two or more functional groups.

The O, S or N atoms is a bonding atom or group for taking the charge transportable structural unit into the siloxane resin, which is formed by reaction of a hydroxyl group, mercapto group or amine introduced into the charge transportable compound with the organic silicon compound having a hydroxyl group or a hydrolyzable group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$$X—(R7—OH)_m$$

wherein

X: structural unit providing charge transportability $R_7$: single bonding group, each of a substituted or an unsubstituted alkylene or arylene group m: integer of 1 to 5

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds

T-1

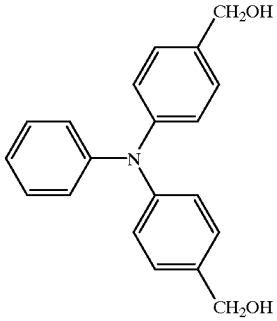

T-2

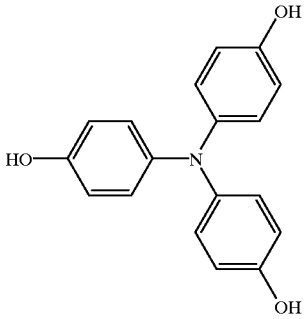

T-3

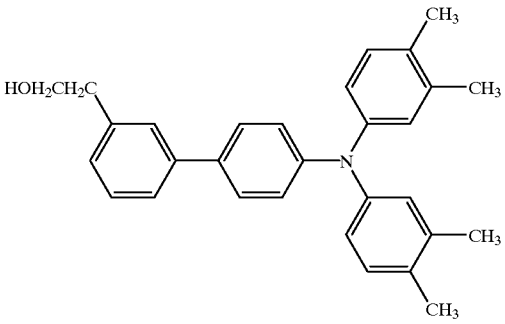

-continued

T-4

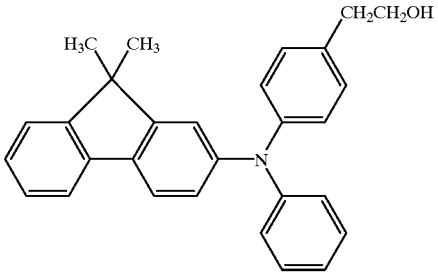

2. Hydrazine Based Compounds

H-1

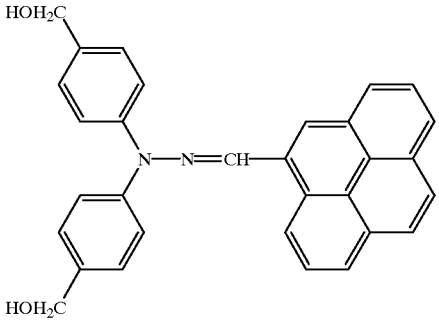

H-2

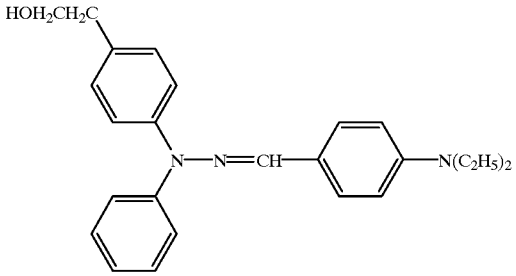

H-3

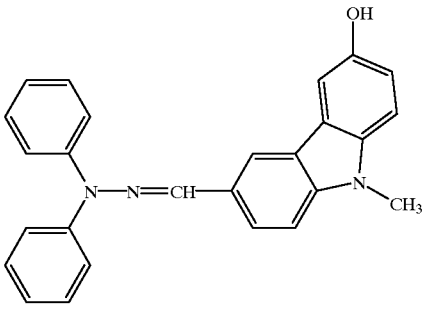

-continued
3. Stilbene Based Compounds
S-1
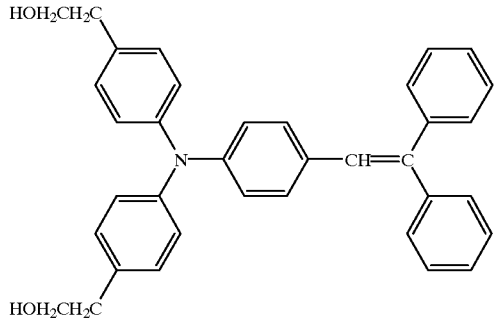
S-2
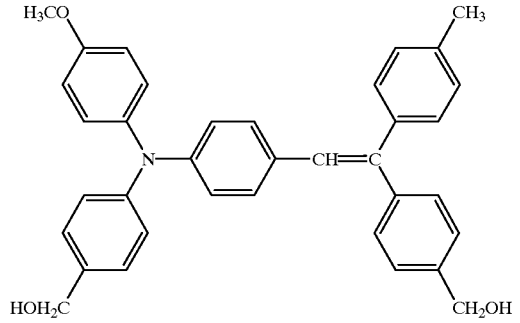
S-3
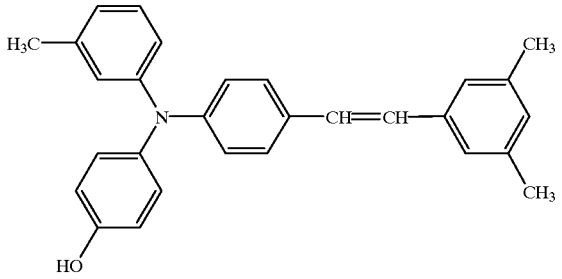
4. Benzidine Based Compounds
Be-1
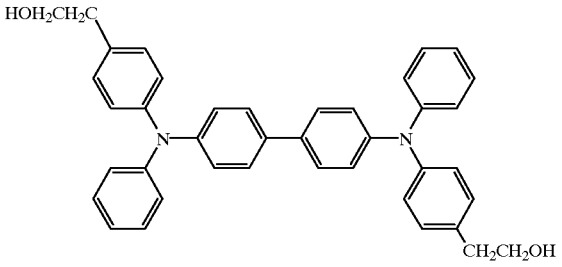
-continued
Be-2
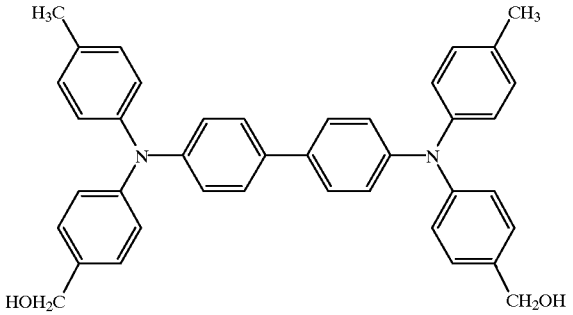
5. Butadiene Based Compounds
Bu-1
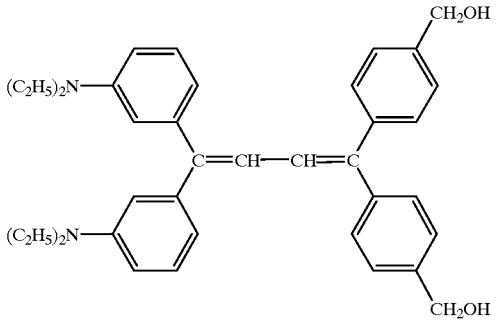
6. Other Compounds
So-1
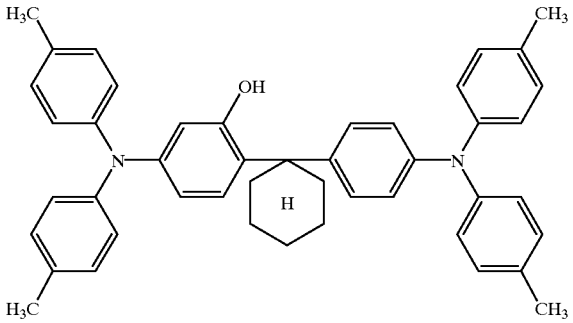
So-2
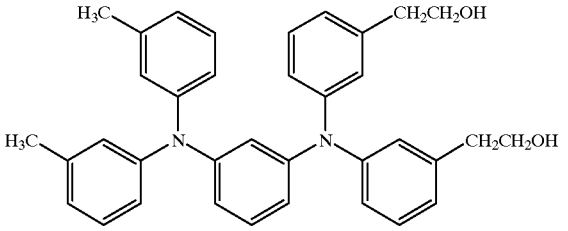
Next, a synthesis example of the charge transportable compound will be described.

Synthesis of Exemplified Compound T-1

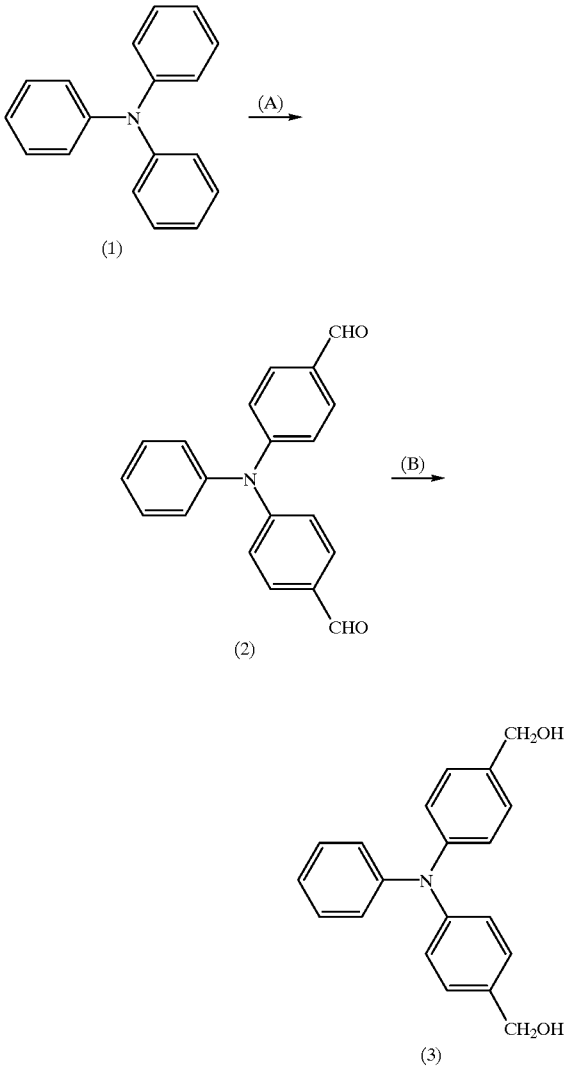

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the reaction solution, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were desposited while stirring. The deposited crystals were collected with filtration, well washed, and dried to obtain Compound (3). The yield was 30 g.

Synthesis of Exemplified Compound S-1

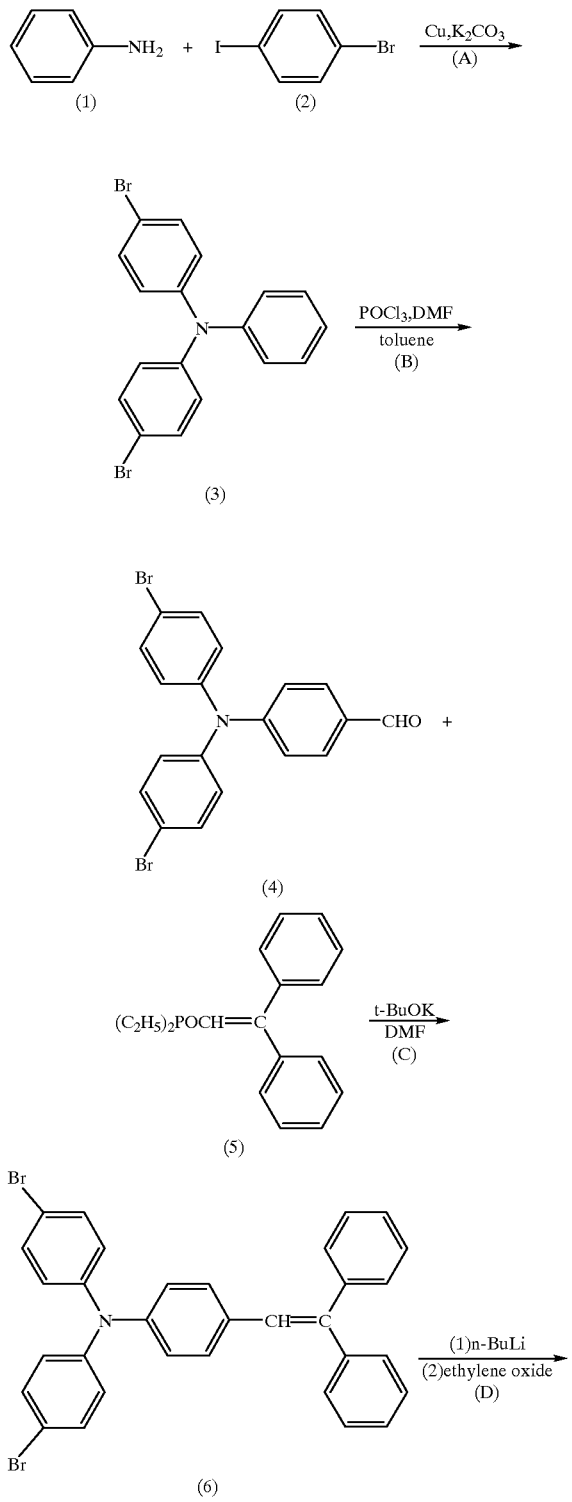

-continued

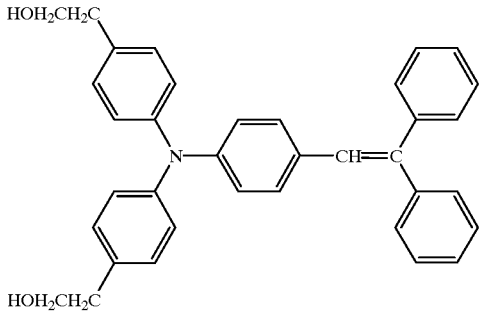

(7)

Step A

Placed in a 300 ml flask equipped with a thermometer and a stirrer were 30 g of Cu, 60 g of $K_2CO_3$, 8 g of Compound (1), and 100 g of Compound (2) and the resulting mixture was heated to about 180° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R8—SH)_m$$

wherein

X: charge transportability providing group $R_8$: single bonding group, each of a substituted or an unsubstituted alkylene group or an arylene group m: integer of 1 to 5

Of these, listed as representative compounds are such as those described below.

V-1

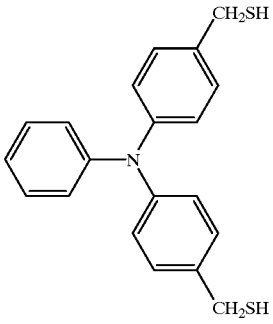

V-2

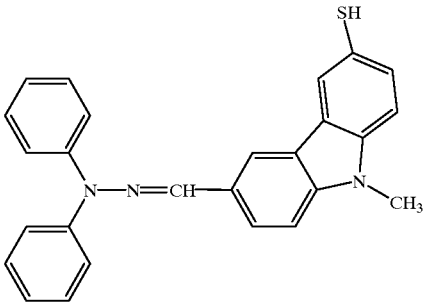

V-3

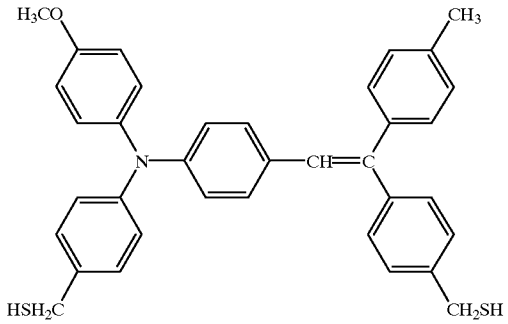

-continued

V-4

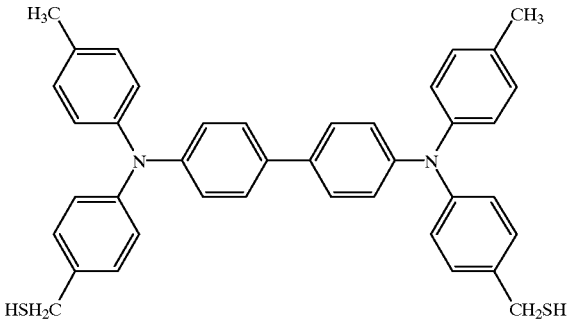

V-5

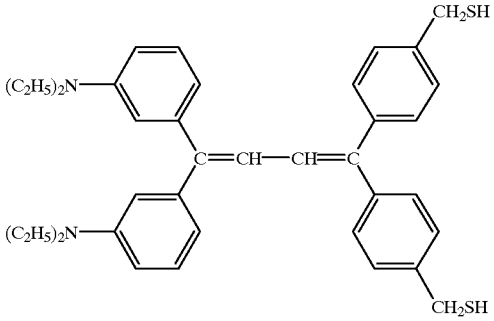

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_9—NR_{10}H)_m$$

wherein

X: charge transportability providing group $R_9$: single bonding group, each of a substituted or an unsubstituted alkylene group or an arylene group $R_{10}$: H, a substituted or unsubstituted alkyl group, a substituted or an unsubstituted aryl group m: integer of 1 to 5

Of these, listed as representative compounds are such as those described below.

W-1

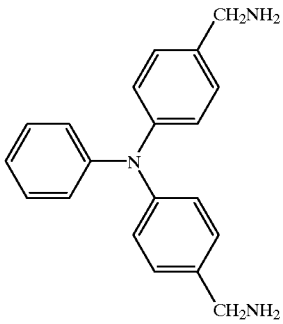

-continued

W-2

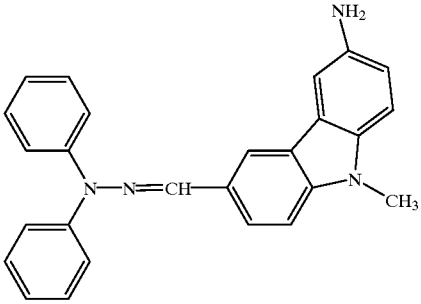

W-3

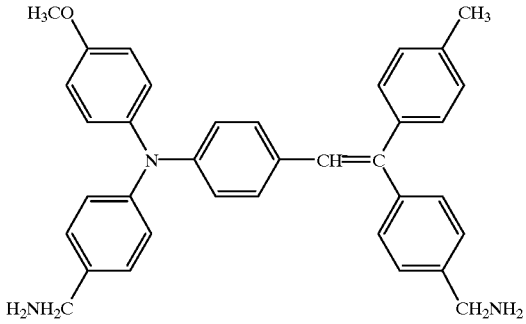

W-4

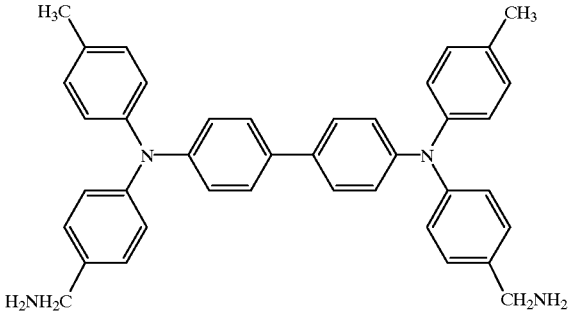

W-5

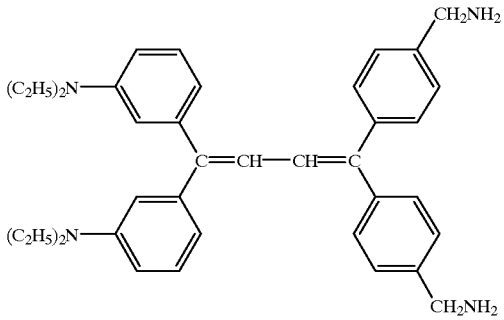

-continued

W-6

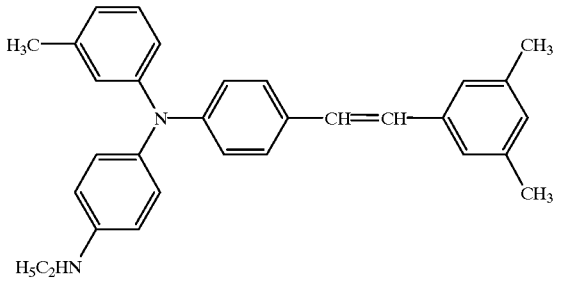

Of charge transportable compounds having an amino group, in the case of primary amine compounds (—$NH_2$), two hydrogen atoms may react with the organic silicone compound, and bonding to the siloxane structure may take place. In the case of secondary amine compounds (—$NHR_{10}$), one hydrogen atom may react with the organic silicone compound, and the remaining $R_{10}$ may be any of a remaining group as a branch, a group resulting in a crosslinking reaction, or a compound group having charge transportability.

Further, transportable compounds having a group containing silicone atom are illustrated below.

The charge transportable compounds having a group containing silicone atom are charge transport compounds having following structure. The compound is contained in a polysiloxane hardenable resin as a partial structure through silicone atom in the molecule.

$$X—(—Y—Si(R_{11})_{3-a}(R_{12})_a))n$$

wherein

X: a group containing structural unit providing charge transportability, $R_{11}$: hydrogen atom, a substituted or unsubstituted alkyl group, a substituted or an unsubstituted aryl group, $R_{12}$: hydrolysable group or a hydroxy group, Y: a substituted or unsubstituted alkylene group, a substituted or an unsubstituted arylene group, a: an integer of 1 to 3, and n: an integer.

Representative examples may be listed as follows.

Si-1

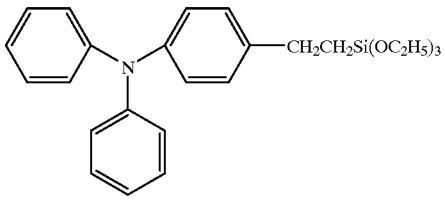

Si-2

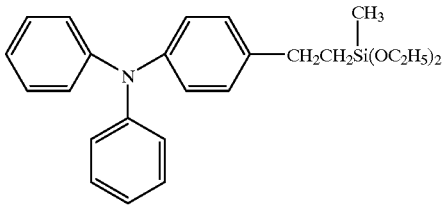

-continued

Si-3

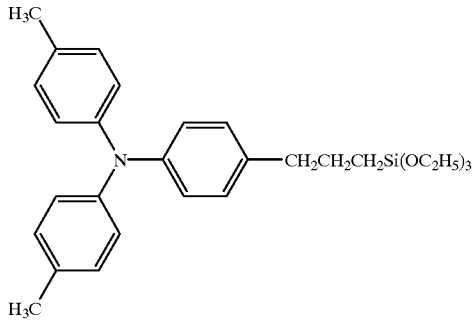

Si-4

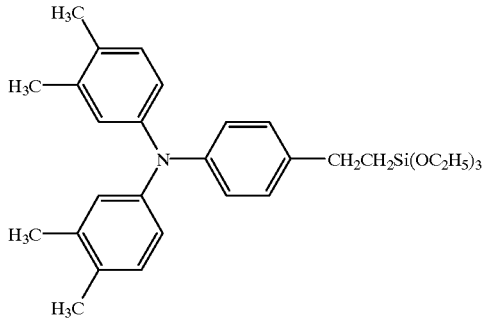

Si-5

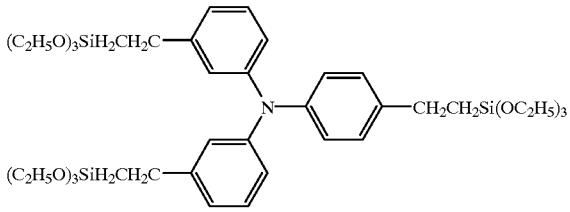

Raw materials of the siloxane resin: The compounds represented Formula A through D (hereinafter referred to A through D) respectively. The ratio of those is preferably to use organic silicon compound: from 0.05 to 1 moles of C and D components per 1 mole of A and B components.

When colloidal silica E is added, it is preferable to use from 1 to 30 parts by weight of E per 100 parts by weight of total amount of A, B, C and D components.

The adding amount of the reactive charge transportable compound F capable of forming the resin layer by reacting with the organic silicon compound and the colloidal silica is preferably from 1 to 500 parts by weight per 100 parts by weight of the total amount of the component of (A), (B), (C) and (D). When the amount of (A) and (B) component is smaller than the above-mentioned range, the hardness of the siloxane resin layer is shortened since the cross-linking density is too low. When the amount of (A) and (B) component is too large, the hardness of the layer is sufficient but the layer is become fragile. A shortage and an excess of the colloidal silica component (E) show similar effects to those of the component (A) and (B), respectively. A too small amount of component (F) causes lowering in the sensitivity and raising in the remained potential since the charge transporting ability of the siloxane resin layer is become too low. When the amount of component (F) is excessive, the strength of the resin layer tends to be lowered.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Usually, the three-dimensional network structure can be formed by a condensation reaction of a composition containing alkoxysilane or alkoxysilane and colloidal silica.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octenate, dibutyl tin dictate, dibutyl tin dilaurate, dibutyl tin mercaptide, dibutyl tin thiocarboxylate and dibutyl tin maleate, an aluminum or zinc salt of octenoic acid or naphthenic acid and an acetylacetone complex.

Further, antioxidants having a partial structure of hindered phenol, hindered amine, thioether, or phosphite may be incorporated into the resin layer of the present invention, and are effective for the improvement of potential stabilization during ambient variation, as well as image quality.

The hindered phenols as described herein means compounds having a branched alkyl group in the ortho position relative to the hydroxyl group of a phenol compound and derivatives thereof. (However, the hydroxyl group may be modified to an alkoxy group.)

Further, listed as hindered amines are compounds having an organic group represented by the following structural formula:

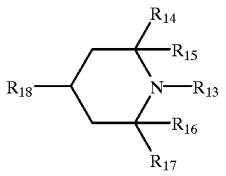

wherein $R_{13}$ represents a hydrogen atom or a univalent organic group, $R_{14}$, $R_{15}$, $R_{16}$, and $R_{17}$ each represents an alkyl group, and $R_{18}$ represents a hydrogen atom, a hydroxyl group, or a univalent organic group.

Listed as antioxidants having a partial hindered phenol structure are compounds described in Japanese Patent Publication Open to Public Inspection No. 1-118137 (on pages 7 to 914).

Listed as antioxidants having a partial hindered amine structure are compounds described in Japanese Patent Publication Open to Public Inspection No. 1-118138 (on pages 7 to 9).

Examples of antioxidant available on the market include the followings.

Hindered phenol type antioxidant: Ilganox 1076, Ilganox 1010, Ilganox 1098, Ilganox 245, Ilganox 1330, Ilganox 3114, and 3,5-di-t-butyl-4-hydroxybiphenyl Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63

Thioether type antioxidant: Sumilizer TPS and Sumilizer TP-D

Phosphite type antioxidant: Mark 2112, Mark PEP 8, Mark PEP 24G, Mark PEP 36, Mark 329K and Mark HP 10.

Among those, preferable are hindered phenol type and hindered amine type particularly.

The added amount of antioxidants is preferably between 0.1 and 10 weight parts per 100 weight parts of the total resin layer composition.

The layer configuration of the electrophotographic photoreceptor of the present invention is not particularly limited. However, the preferred configuration is one in which the resin layer of the present invention is applied onto a photosensitive layer, such as a charge generating layer, a charge transport layer, or a charge generating-transport layer (a single layer type photosensitive layer which has both functions of charge generation and charge transport). Further, each of said charge generating layer, charge transport layer or charge generating-charge transport layer may be comprised of a plurality of layers.

The charge generating materials (CGM) incorporated into the photosensitive layer of the present invention may be employed individually or in combination with a suitable binder resin to form a resin layer. The representative examples of the charge generating materials include, for example, pyrylium dyes, thiopyrylium dyes, phthalocyanine pigments, anthanthrone pigments, dibenzpyrenequinone pigments, pyranthrone pigments, azo pigments, trisazo pigments, disazo pigments, indigo pigments, quinacridone pigments, cyanine dyes etc.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

In the present invention, the ratio of the charge generating material in the charge generating layer to the binder resin is preferably between 1:10 and 10:1 in terms of weight ratio. Further, the thickness of the charge generating layer is preferably no more than 5 $\mu$m, and is more preferably between 0.05 and 2 $\mu$m.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 10:1 and 1:10 in terms of weight ratio.

The thickness of the charge transport layer is preferably between 5 and 50 μm, and is more preferably between 10 and 40 um. Furthermore, when a plurality of charge transport layers are provided, the thickness of the upper charge transport layer is preferably no more than 10 μm, and is preferably less than the total layer thickness of the charge transport layer provided under the upper layer of the charge transport layer.

The hardenable siloxane resin layer may share the function of the aforementioned charge transport layer. However, the hardenable siloxane resin layer is preferably provided as another layer on a photosensitive layer such as a charge transport layer or a charge generating layer, or a single layer type charge generating-transport layer. In such cases, an adhesive layer is preferably provided between the aforementioned photosensitive layer and the resin layer of the present invention.

Next, listed as an electrically conductive support of the electrophotographic photoreceptor of the present invention is:

1) metal plates such as an aluminum plate, a stainless steel plate, and the like
2) those in which a thin layer of metal such as aluminum, palladium, gold, and the like is provided on a support such as paper, plastic film, and the like, employing lamination or vacuum evaporation
3) those in which the layer of an electrically conductive compound such as an electrically conductive polymer, indium oxide, tin oxide, and the like is provided on a support such as paper, plastic film, and the like, employing coating or vacuum evaporation, and the like.

Employed mainly as materials for the electrically conductive support employed in the present invention are metals such as aluminum, copper, brass, steel stainless steel, and the like, as well as plastics. Any of these is processed in a belt shape or drum shape, and then employed. Commonly thin-walled cylindrical aluminum tubes produced by extrusion or drawing are frequently employed.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these-solvents may be employed individually or in combination of two types or more.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the -above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

The photosensitive layer is prepared by heat drying at temperature of more than 50° C. or higher, preferably 60 to 200° C. after forming the surface layer by coating. The residual coating solvent can be reduced and at the same time, the hardenable layer can be hardened sufficiently.

In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (nylon 6, nylon 66, nylon 610, copolymerized nylon, alkoxymethylated nylon, etc.), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 μm, and is most preferably between 0.1 and 5 μm.

In the photoreceptor of the invention a conductive layer may be provided between the support and the inter layer for the purposes of providing a coating to compensate surface defects of the surface of the support and preventing of occurrence of interference mottle which becomes problematic when the image writing source is laser light. The conductive layer can be formed by coating a composition in which conductive powder such as carbon black, metal particles or metal oxide particles are dispersed in suitable binder resin and drying it. The thickness of the conductive layer is preferably 5 to 40 μm, particularly 10 to 30 μm.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

Next, cleaning member is described.

FIG. 1 is a cross-sectional view of an example of cleaning member employed in the invention.

Preferable values of contacting weight P and contacting angle θ of the cleaning blade to the photoreceptor are preferably 5 to 40 g/cm and 5 to 35° respectively.

Free length L of the cleaning blade denotes the length from end portion of the supporting member 3 to head of the blade before deforming as demonstrated by FIG. 1. The preferable free length is 3 to 15 mm. Thickness of the blade is preferably 0.5 to 10 mm.

Contact weight P is normal direction vector value of contact stress P' when the cleaning blade 2 is pressed to the drum 1.

Contact angle θ is an angle formed between tangential line X at contacting point A on the drum and the blade before deforming.

Urethane rubber, silicone rubber, chroloprene rubber, butadiene rubber etc. are known for the raw material employed for cleaning blade. Among them the urethane rubber, is preferred to other rubber in view of excellent abrasion resistance. Preferable example of the urethane rubber is that obtained by reacting polycaprolactone ester with polyisocyanate to make hard as disclosed in Japanese Patent Open to Public Publication No. 59-30574.

Curling up of blade is restrained effectively by regulating both of hardness and impact resilience simultaneously among the physical property of the elastic rubber blade. When JISA hardness at 25±5° C. is below 65, the blade tends to curl up, while when it exceeds 80, sufficient cleaning properties are not obtained When the impact resilience is below 20 percent, sufficient cleaning properties are not obtained, while when it exceeds 75 percent, the blade tends to curl up. (JISA hardness and impact resilience are subject to physical test of valcanized rubber stipulated by JIS-K6301.)

Figure 2:
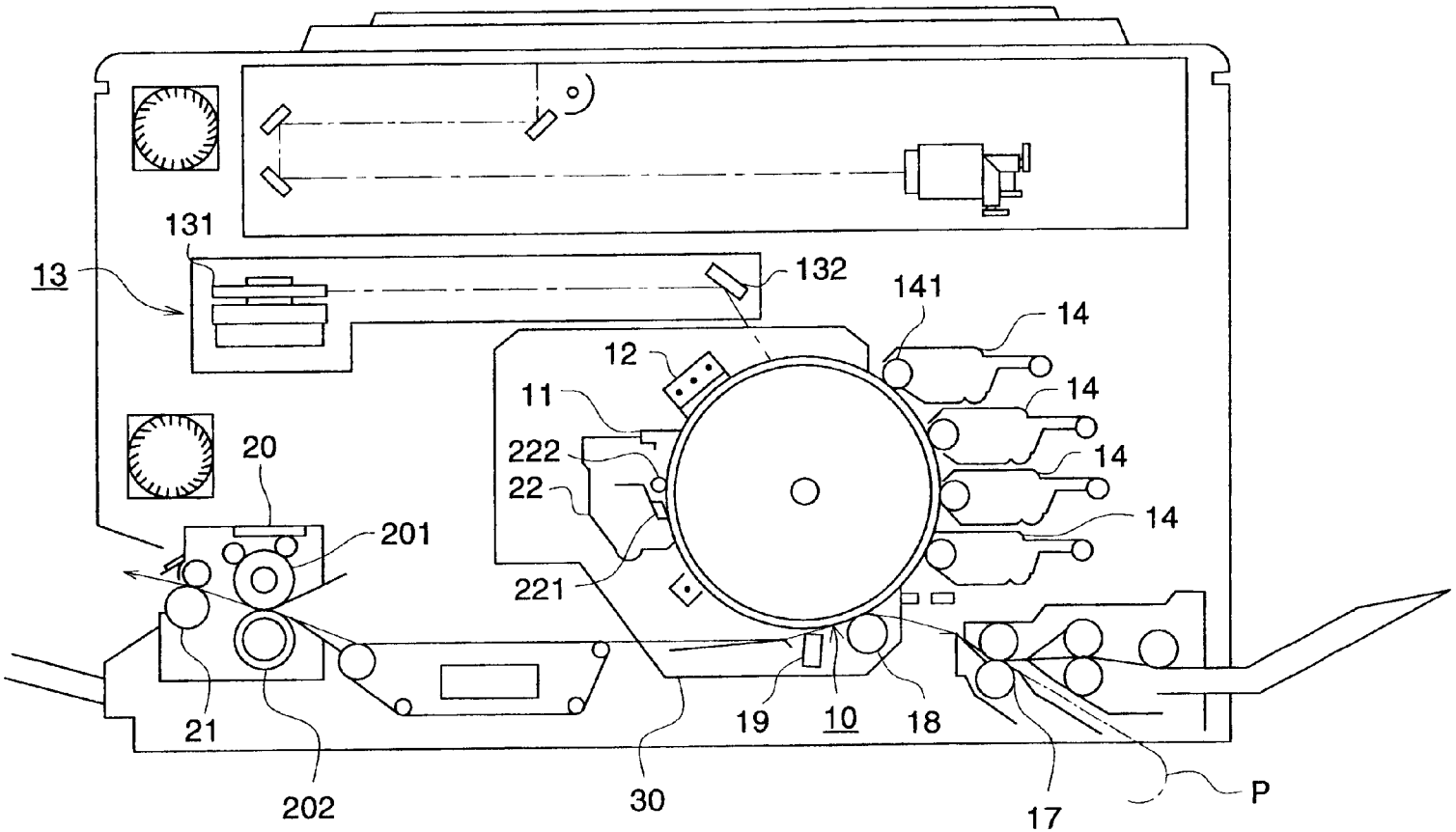
FIG. 2 is a cross-sectional view of one example of an image forming apparatus having an electrophotographic photoreceptor of the present invention.

FIG. 2 shows a cross-sectional view of an image forming apparatus comprising the electrophotographic photoreceptor of the present invention.

In FIG. 2, reference numeral 10 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 11 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 2 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 10, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means, which is not shown in the figure, so as to form a layer having a thickness of 100 to 600 $\mu$m on the development sleeve, and conveyed to a development zone to achieve development. At the time, development is generally carried out by applying direct current and/or alternative current bias voltage to the gap between the photoreceptor drum 10 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 10.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 10 in synchronized transfer timing, and multicolor images are simultaneously transferred onto the recording sheet which is appropriately placed.

Subsequently, the recording sheet (referring as recording material including plane paper, OHP sheet etc.) is subjected to charge elimination employing separation brush (in the separation unit) 19 which is brought into pressure contact at almost the same time when the transfer roller is brought into pressure contact, is separated from the circumferential surface of the photoreceptor drum 10, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 10 and are prepared for the subsequent formation of a new toner image.

On the other hand, the photoreceptor drum 10, from which the recording sheet P has been separated, is subjected to removal and cleaning of the residual toner through pressure contact of the blade 221 of cleaning unit 22, is again subjected to charge elimination employing the exposure section 11, subjected to recharging employing the charging unit 12, and subjected to a subsequent image forming process. Further, when color images are formed upon being superimposed on the photoreceptor, the above-mentioned blade 221 is immediately withdrawn after cleaning the photoreceptor surface of the photoreceptor drum.

Further, reference numeral 30 is a detachable cartridge in which a photoreceptor, a transfer unit, a separation unit, and a cleaning unit are integrated.

The electrophotographic image forming apparatus is constituted in such a manner that components such as the above-mentioned photoreceptor, development unit, cleaning unit the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

When an image forming apparatus is employed as a copier or a printer, image exposure is carried out in such a manner that light reflected from an original document or a light a,transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

The recording sheet is representatively a paper, and includes those capable of transferring unfixed image, for example, PET film employed for OHP.

EXAMPLES

In the following, the embodiments of the present invention will now be specifically described. However, the present invention is not limited to these cited examples. Incidentally, "parts" in the text means "weight parts", unless otherwise specified.

(Preparation of Toner)

Preparation of Toner 1

Lit A mixture consisting of 165 g of styrene, 25 g of n-butyl acrylate, 20 g of carbon black, 8 g of methacrylic acid, and 20 g of lower molecular weight polypropylene was dispersed employing a sand grinder, while being heated at 30 ° C. Subsequently, 2.5 g of 2,2'-azobis(2,4-valeronitorile) were added as a polymerization initiator, and a polymerizable monomer composition was prepared. Subsequently, 450 g of 1M aqueous sodium phosphate was added to 710 g of ion-exchanged water, and 68 g of 1.0M calcium chloride were gradually added to the resultant mixture while stirring at 12,000 rpm employing a TK homomixer. Thus a suspension was prepared in which tricalcium phosphate was dispersed. The aforementioned polymerizable monomer composition was added to the resultant .suspension, and stirred at 10,000 rpm for 20 minutes, employing a TK homomixer. Thus the polymerizable monomer composition was dispersed in a water based medium to obtain liquid droplets, having an average droplet diameter of approximately 8 $\mu$m. Thereafter, the obtained suspension underwent reaction at 75° C. for 10 hours. After cooling, hydrochloric acid was added and tricalcium phosphate was dissolved and subsequently removed. The resultant product was then filtered, washed, and subsequently dried. Thus spherical particles having a volume average particle diameter of 7.9 $\mu$m were obtained, and were designated as Particles 1.

Toner 1 was obtained by adding hydrophobic silica (having a number average primary particle diameter of 12 nm) to Particles 1, obtained by the above mentioned suspension polymerization, in an amount of one percent by weight. Preparation of Toner 2

Added to 10.0 liters of pure water was 0.90 g of sodium n-dodecyl sulfate, and was dissolved while stirring. While stirring, gradually added to the resultant solution was 1.20 kg of Regal 330R (carbon black manufactured by Cabot Corporation). After the addition, the resultant mixture was thoroughly stirred for one hour, and was subsequently subjected to continuous dispersion over 20 hours, employing a sand grinder (a medium type homogenizer).

The resultant dispersion was cooled to no more than 40° C. and stirring was terminated. Then filtration was carried out employing a pole filter. The obtained dispersion was designated as Latex A1.

Further, the glass transition temperature of resin particles in Latex A1 was 57° C.; the softening point of the same was 121° C.; and regarding the molecular weight distribution of the same, the weight average molecular weight and weight average particle diameter were 12,700 and 120 nm, respectively.

Added to 12.0 liters of ion-exchanged water were 200.7 g of potassium persulfate, which was dissolved while stirring at room temperature. The resultant solution was designated as Initiator Solution A.

Placed in a reaction vessel equipped with a thermometer, a cooling pipe, and a nitrogen introduction device were 3.41 kg of wax emulsion (polypropylene emulsion having a number average molecular weight of 3000, a number average primary particle diameter of 120 nm, and a solid portion concentration of 29.9 percent), an anionic surface active agent and a nonionic surface active agent, and the resultant mixture was stirred. Subsequently, 44.0 liters of ion-exchanged water were added.

The resultant mixture was heated to 70° C., and then Initiator Solution B was added. At that time, added was a solution which was previously prepared by mixing 11.0 kg of styrene, 4.00 kg of n-butyl acrylate, 1.04 kg of methacrylic acid, and 9.02 g of t-dodecylmercaptan.

Thereafter, the temperature of the resultant mixture was controlled at 72±2° C. and stirring was carried out for 6 hours. Further, the temperature was raised to 80±2° C., and stirring was carried out for further 12 hours.

The resultant dispersion was cooled to 40° C. or less, and stirring was terminated. Filtration was then carried out employing a pole filter. The filtered dispersion was designated as Latex B1.

Further, the glass transition temperature of resin particles in Latex B1 was 58° C.; the softening point of the same was 132° C.; and regarding the molecular weight distribution of the same, the weight average molecular weight and weight average particle diameter were 245,000 and 110 nm, respectively.

An aqueous solution comprised of 5.36 kg of sodium chloride, as a salting-out agent, and 20.0 liters of ion-exchanged water was designated as Sodium Chloride Solution A.

Placed in a reaction vessel equipped with a thermometer, a cooling pipe, and a nitrogen introduction device were 20.0 kg of Latex A1 and 5.2 kg of Latex B1, prepared as described above, 0.4 kg of colorant dispersion, and 20.0 kg of ion-exchanged water, and the resultant mixture was stirred. Then said mixture was heated to 40° C. and Sodium Chloride Solution G, 6.00 kg of isopropanol, and Nonionic Surface Active Agent Solution A were added in said order. Thereafter, the resultant mixture was set aside for 10 minutes, and was then heated to 85° C. over 60 minutes. The temperature of the mixture was then maintained at 85±2° C. while stirring for 6 hours, and the reaction product was subjected to salting-out/fusion. Thereafter, the resultant product was cooled to no more than 40° C., and stirring was terminated. Filtration was carried out employing a 45 $\mu$m opening sieve. The resultant filtrate was designated as Association Composition (1).

Subsequently, Association Composition (1) was filtered employing a Nutsche funnel and wet cake-like colored particles were collected. Thereafter, said colored particles were washed with ion-exchanged water.

Said wet cake-like colored particles, which had been washed as described above, were removed from the Nutsche funnel and subsequently were subjected to tray drying at 40° C. for 100 hours employing an air blast dryer.

The colored particles obtained as described above were designated as Colored Particles 2. Further, the resin particles, which were components of said Colored Particles 2, exhibited the following parameters: the molecular weight was 55,000 in terms of the weight average molecular weight; the softening point was 125° C.; the glass transition point was 57° C.; the volume average particle diameter was 6.53 $\mu$m; the shape coefficient was 1.92; and those having a shape coefficient in the range of 1.5 to 2.0 were 97 percent by the number of particles.

Toner 2 was obtained by adding hydrophobic silica (having an average primary particle diameter of 12 nm) in an amount of one percent by weight to said Colored Particles 2.

Preparation of Toner 3

A mixture consisting of 100 parts of styrene acrylic resin, 10 parts of carbon black, and 4 parts of low molecular weight polypropylene (having a number average molecular weight of 3,000) was fused, kneaded, and crushed, and colored particles having a volume average particle diameter of 6.9 $\mu$m were obtained. The resultant particles were designated as Colored Particles 3.

Toner 3 was obtained by adding hydrophobic silica (having an average primary particle diameter of 12 nm) in an amount of one percent by weight to said Colored Particles 3 obtained by subsequent kneading and crushing.

(Preparation of Developer Materials)

Developer materials comprised of the toner and the carrier described below were prepared.

Further, each of the aforementioned Toner 1, Toner 2, and Toner 3 was blended with ferrite carrier particles having a volume average particle diameter of 45 μm, which had been coated with a styrene acrylic resin so that the toner concentration was 6 percent, and was employed for printing evaluation. The resultant developer materials were designated as Developer Material 1, Developer Material 2, and Developer Material 3, which correspond to the aforementioned toners.

(Preparation of Photoreceptors)

Preparation of Photoreceptor 1

Employed as an electrically conductive support, was an aluminum support having a surface roughness Rz (average roughness at 10 points) of 1.5 μm, a diameter of 80 mm, and a height of 355 mm.

<Intermediate Layer>

| | |
|---|---|
| Titanium chelate compound (TC-750, manufactured by Matsumoto Seiyaku) | 30 g |
| Silane coupling agent | 17 g |
| 2-Propanol | 150 ml |

were blended and dissolved. Thus an intermediate coating composition was prepared. The resulting coating composition was applied onto a cylindrical aluminum base body employing a dip coating method, and subsequently dried at 120° C. for one hour. Thus a 1.0 μm thick intermediate layer was formed.

<Charge Generating Layer>

| | |
|---|---|
| Titanyl phthalocyanine | 60 g |
| Silicone resin solution (15% KR5240 xylene-butanol solution, manufactured by Shin-Etsu Kagaku Co.) | 700 g |
| 2-Butanone | 2000 ml |

were blended and subsequently dispersed for 10 hours employing a sand mill. Thus a charge generating layer coating composition was prepared. The resultant coating composition was applied onto the aforementioned intermediate layer employing a dip coating method, whereby a 0.2 μm thick charge generating layer was formed.

<Charge Transport Layer>

| | |
|---|---|
| Charge transport material (4-methoxy-4'-(4-methyl-α-phenylstyryl)triphenylamine | 200 g |
| Bisphenol Z type polycarbonate (Ubiron Z300, manufactured by Mitsubishi Gas Kagaku Co.) | 300 g |
| 1,2-Dichloroethane | 2000 ml |

were blended and dissolved. Thus a charge transport layer coating composition was prepared. The resultant coating composition was applied onto the aforementioned charge generating layer employing a dip coating method, whereby a charge transport layer having a dry thickness of 25 μm was formed.

<Resin Layer>

| | |
|---|---|
| Trimethoxymethylsilane | 180 g |
| 1-Butanol | 280 ml |
| 1% aqueous acetic acid solution | 106 ml |

were blended and stirred at 60° C. for 2 hours. Thereafter, 370 ml of 1-butanol were further added and stirred for further 48 hours.

Blended with the resultant mixture were 67.5 g of dihydroxymethyltriphenylamine (Exemplified Compound T-1), 1.7 g of an antioxidant (Sanol LS2626, manufactured by Sankyo Co.), and 4.5 g of dibutyl tin acetate). The resultant composition was applied as the resin layer having a dry thickens of 1 μm, and subsequently dried at 120° C. for one hour. Thus Photoreceptor 1 was prepared.

Preparation of Photoreceptor 2

Subsequently, Photoreceptor 2 was prepared in the same manner as Photoreceptor 1, except that dihydroxytriphenylamine (Exemplified Compound T-1) in the resin layer of Photoreceptor 1 was replaced with 4-[2-(triethoxysilyl) ethyl]triphenylamine (Exemplified Compound Si-1).

Preparation of Photoreceptor 3

Next, Photoreceptor 3 was prepared in the same manner as Photoreceptor 1, except that dihydroxytriphenylamine (Exemplified Compound T-1) in the resin layer of Photoreceptor 1 was removed.

Evaluation

Image Evaluation Apparatus

Evaluation was carried out employing a digital copier, Konica 7050, in which photoreceptors and toners prepared as described above were combined as shown in Table 1 and each of the combinations was mounted. Said digital copier, Konica 7050, utilized semiconductor laser exposure as well as a reversal development process, and as shown in FIG. 2, was capable of carrying out each process of charging, exposure, development, transfer, cleaning, and charge elimination exposure around the photoreceptor. Employed as cleaning means was the blade cleaning described below. Namely, a polyurethane composed elastic rubber blade, having a rubber hardness of JISA 70 degrees, an impact resilience of 25, a thickness of 2 mm, and a free length of 9 mm, was brought into contact with the photoreceptor at a contact angle of 20 degrees in the direction counter to the rotation of the photoreceptor at a pushing pressure of 20 g/cm employing a dead load weight system.

Further, development conditions were those described below.

DC bias: −500 V

Dsd (distance between the photoreceptor and the development sleeve): 600 μm

Regulation of developer material layer: magnetic H-Cut system

Developer material thickness: 700 μm

Development sleeve diameter: 40 mm

TABLE 1

| Example No. | Developer Material No. | Photoreceptor No. |
|---|---|---|
| Example 1 | Developer Material 1 | Photoreceptor 1 |
| Example 2 | Developer Material 2 | Photoreceptor 1 |
| Example 3 | Developer Material 1 | Photoreceptor 2 |
| Example 4 | Developer Material 2 | Photoreceptor 2 |

TABLE 1-continued

| Example No. | Developer Material No. | Photoreceptor No. |
|---|---|---|
| Comparative 1 | Developer Material 3 | Photoreceptor 1 |
| Comparative 2 | Developer Material 3 | Photoreceptor 2 |
| Comparative 3 | Developer Material 1 | Photoreceptor 3 |
| Comparative 4 | Developer Material 2 | Photoreceptor 3 |
| Comparative 5 | Developer Material 3 | Photoreceptor 3 |

Evaluation Methods

Evaluation was carried out as follows: an A4 sized text image having a pixel ratio of 7 percent was employed, 50,000 sheets were printed alternatively at high temperature and high humidity conditions of 35° C. and 80 percent RH, and after printing of every 10,000 sheets, the copier was idled for 12 hours.

Resultant images were evaluated as follows: after finishing 10,000 copies, as well as after idling for 12 hours, halftone, solid white, and solid black images were printed, and a maximum image density, a background staining, and the presence of smearing were evaluated. Further, evaluated as cleaning properties were image problems such as the presence of streaking, white or black spotting (having a diameter of at least 0.3 mm), and the presence of foreign matter adhered onto the photoreceptor surface.

Imagine density was determined as follows: the absolute reflection density of the solid black image was measured at five sites, employing an RD-918, manufactured by Mcbeth Co., and the resultant average value was designated as the image density. Further, a background staining value was obtained as follows: the absolute reflection density of the solid white image was measured at 10 different sites employing a reflection densitometer, RD-918, manufactured by Mcbeth Co. while the reflection density of blank paper was regarded as "0", and the highest density was expressed employing the relative reflection density.

Table 2 shows the evaluation results.

TABLE 2-1

| | Image Density | | Background Staining | |
|---|---|---|---|---|
| Example No. | Initial | After printing 50,000 sheets | Initial | After printing 50,000 sheets |
| Example 1 | 1.41 | 1.37 | 0.001 | 0.003 |
| Example 2 | 1.42 | 1.41 | 0.001 | 0.001 |
| Example 3 | 1.41 | 1.39 | 0.001 | 0.004 |
| Example 4 | 1.42 | 1.41 | 0.001 | 0.001 |
| Comparative 1 | 1.41 | 1.26 | 0.001 | 0.012 |
| Comparative 2 | 1.41 | 1.26 | 0.001 | 0.013 |
| Comparative 3 | 1.41 | 1.36 | 0.001 | 0.009 |
| Comparative 4 | 1.42 | 1.37 | 0.001 | 0.009 |
| Comparative 5 | 1.41 | 1.26 | 0.001 | 0.013 |

TABLE 2-2

| Example No. | Formation of Smearing | Presence of Image Problems after Printing 50,000 Sheets |
|---|---|---|
| Example 1 | no smearing | no problem |
| Example 2 | no smearing | no problem |
| Example 3 | no smearing | no problem |
| Example 4 | no smearing | no problem |
| Comparative 1 | formed after printing 20,000 sheets | minute adhesion on the photoreceptor |

TABLE 2-2-continued

| Example No. | Formation of Smearing | Presence of Image Problems after Printing 50,000 Sheets |
|---|---|---|
| Comparative 2 | formed after printing 20,000 sheets | minute adhesion on the photoreceptor |
| Comparative 3 | no smearing | formation of black bands after printing halftone image due to insufficient cleaning presence of ten, or so, black spots on the solid white image |
| Comparative 4 | no smearing | presence of ten, or so, black spots on the solid white image |
| Comparative 5 | slight smearing after printing 50,000 sheets | presence of ten, or so, black spots on the solid white image |

As shown in Table 2, in the practical image copying test under high temperature and high humidity conditions, developer materials, which satisfied requirements of the present invention, resulted in excellent image quality regarding density as well as background staining, and further, results in excellent images in which image problems such as image blurring, streaking, and spotting due to insufficient cleaning were markedly minimized.

The present invention is capable of providing an image forming method which minimizes image problems such as image blurring, streaking, and spotting under high temperature and high humidity conditions and also makes it possible to obtain copied images with high durability as well as high image quality, by utilizing a constitution in which a specified polymerized toner is combined with an organic electrophotographic photoreceptor, an image forming apparatus, and a developer material employed with said apparatus.

What is claimed is:

1. An image forming method in which a latent image on an electrophotographic photoreceptor is developed employing a developer material, and after transferring the resultant developed image on a recording material, the residual toner on said photoreceptor is removed, wherein said electrophotographic photoreceptor comprises an electrically conductive support having thereon a resinous layer comprising siloxane based resin containing a structural unit having charge transport performance and a cross-linked structure, and said developer material comprises a toner which is obtained by suspension-polymerizing a polymerizable composition comprised of at least polymerizable monomer and colorant or a toner which is obtained by fusing at least said resin particles in an aqueous medium.

2. The image forming method of claim 1, wherein electrophotographic photoreceptor comprises said resinous layer in outermost layer of the electrophotographic photoreceptor.

3. The image forming method of claim 2, wherein the siloxane based resin contains a three-dimensional network structure and the toner has volume average particle diameter of 3 to 9 $\mu$m.

4. The image forming method of claim 3, wherein the toner is obtained by suspension-polymerizing a polymerizable composition comprised of at least polymerizable monomer and colorant.

5. The image forming method of claim 3, wherein the toner is obtained by fusing at least said resin particles in an aqueous medium.

6. The image forming method of claim 5, wherein ratio of toner particles having shape coefficient of 1.5 to 2.0 is at least 80 percent by number to whole toner particles $$\text{Shape coefficient}=[(\text{maximum diameter}/2)^2\times\pi].$$

7. The image forming method of claim 1, wherein the toner has volume average particle diameter of 3 to 9 $\mu$m.

8. The image forming method of claim 1, wherein the toner obtained by fusing has shape coefficient of toner particles of 1.3 to 2.2

$$\text{Shape coefficient}=[(\text{maximum diameter}/2)^2\times\pi].$$

9. The image forming method of claim 8, wherein ratio of toner particles having shape coefficient of 1.5 to 2.0 is at least 80 percent by number to whole toner particles.

10. The image forming method of claim 8, wherein the resin is composed of an organic silicone compound represented by one of formula (A), (B), (C) and (D).

Formula (A)

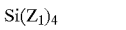

Formula (B)

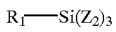

Formula (C)

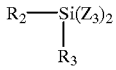

Formula (D)

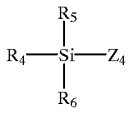

wherein, $R_1$ through $R_6$ are each an organic group in which a carbon atom thereof is directly boned with the silicon atom in the formula, each of $Z_1$ to $Z_4$ is a hydroxyl group or a hyrolyzable group.

11. The image forming method of claim 10, wherein the resin is composed of an organic silicone compound represented by formula (A), (B), (C) and (D), amount of compound represented by formula (C) and represented by formula (D) is 0.05 to 1 mol per 1 mol of amount of compound represented by formula (A) and represented by formula (B).

12. The image forming method of claim 1, wherein the siloxane based resin contains a three-dimensional network structure.

13. The image forming method of claim 1, wherein the siloxane based resin containing a structural unit having charge transport performance is represented by formula,

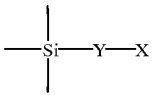

in the formula, X is a group having charge transportability and connects to Y by carbon atom or silicon atom composing the group.

14. The image forming method of claim 13, wherein Y is oxygen, sulfur or nitrogen atom.

15. An image forming apparatus comprising an electrophotographic photoreceptor, developing device supplying developer to developing for developing a latent image formed on the photoreceptor and a cleaning device removing residual toner on the photoreceptor, wherein the electrophotographic photoreceptor comprises an electrically conductive support having thereon a resinous layer comprising siloxane based resin containing a structural unit having charge transport performance and a cross-linked structure, and the developing device comprises a toner which is obtained by suspension-polymerizing a polymerizable composition comprised of at least polymerizable monomer and colorant or a toner which is obtained by fusing at least said resin particles in an aqueous medium.

* * * * *